US010486221B2

(12) United States Patent
Frost et al.

(10) Patent No.: US 10,486,221 B2
(45) Date of Patent: Nov. 26, 2019

(54) METHOD FOR PRODUCING A MOTOR VEHICLE COMPONENT

(71) Applicant: Benteler Automobiltechnik GmbH, Paderborn (DE)

(72) Inventors: Georg Frost, Steinheim (DE); Jochem Grewe, Salzkotten (DE)

(73) Assignee: BENTELER AUTOMOBILTECHNIK GMBH, Paderborn (DE)

( * ) Notice: Subject to any disclaimer, the term of this patent is extended or adjusted under 35 U.S.C. 154(b) by 0 days.

(21) Appl. No.: 15/769,820

(22) PCT Filed: Oct. 11, 2016

(86) PCT No.: PCT/DE2016/100472

§ 371 (c)(1),
(2) Date: Apr. 20, 2018

(87) PCT Pub. No.: WO2017/067537

PCT Pub. Date: Apr. 27, 2017

(65) Prior Publication Data

US 2018/0304341 A1 Oct. 25, 2018

(30) Foreign Application Priority Data

Oct. 23, 2015 (DE) ..... 10 2015 118 099

(51) Int. Cl.
*B21D 1/02* (2006.01)
*B21D 47/01* (2006.01)
(Continued)

(52) U.S. Cl.
CPC ..... *B21D 47/01* (2013.01); *B21C 23/142* (2013.01); *B21C 35/023* (2013.01); *B21D 1/02* (2013.01);
(Continued)

(58) Field of Classification Search
CPC .. B21D 3/02; B21D 3/14; B21C 25/08; Y10T 29/49627; Y10T 29/49629;
(Continued)

(56) References Cited

U.S. PATENT DOCUMENTS 3,235,954 A * 2/1966 Fromson ..... B21C 37/14 156/145
4,241,146 A 12/1980 Sivachenko et al.
(Continued)

FOREIGN PATENT DOCUMENTS

CN 1768154 A 5/2006
CN 101875079 A 11/2010
(Continued)

OTHER PUBLICATIONS

Office Action for Chinese Application No. 201680015380.3 dated Sep. 5, 2018; 8pp.
(Continued)

*Primary Examiner* — Jason L Vaughan
*Assistant Examiner* — Amanda Kreiling
(74) *Attorney, Agent, or Firm* — Hauptman Ham, LLP

(57) ABSTRACT

A method for producing a motor vehicle component from a lightweight metal alloy is disclosed including extruding a profile having at least two wall thicknesses that are mutually dissimilar in the cross section, rolling the extruded profile in portions in the extrusion direction. The rollers in the roller spacing thereof are variable. Cutting-to-length the extruded and in portions rolled profile so as to form a semi-finished product, and forming the semi-finished product so as to form the motor vehicle component.

19 Claims, 10 Drawing Sheets

(51) Int. Cl.

| | |
|---|---|
| ***B21D 22/26*** | (2006.01) |
| ***B21D 35/00*** | (2006.01) |
| ***B21D 53/88*** | (2006.01) |
| ***B21C 35/02*** | (2006.01) |
| ***B21C 23/14*** | (2006.01) |
| ***B21D 28/26*** | (2006.01) |
| *B21B 1/095* | (2006.01) |

(52) U.S. Cl.
CPC ..... *B21D 22/26* (2013.01); *B21D 28/26* (2013.01); *B21D 35/006* (2013.01); *B21D 53/88* (2013.01); *B21B 1/095* (2013.01)

(58) Field of Classification Search
CPC ..... Y10T 29/49622; Y10T 29/49631; Y10T 29/49634
See application file for complete search history.

(56) References Cited

U.S. PATENT DOCUMENTS

| | | | | |
|---|---|---|---|---|
| 4,967,473 | A | 11/1990 | Wessel | |
| 5,194,199 | A * | 3/1993 | Thum | B29C 44/1242 264/275 |
| 6,070,448 | A * | 6/2000 | Eipper | B21B 1/0805 72/363 |
| 6,552,480 | B1 | 4/2003 | Ohmae et al. | |
| 7,927,436 | B2 * | 4/2011 | Sano | B21C 23/002 148/689 |
| 2006/0033347 | A1 | 2/2006 | Hauger et al. | |
| 2006/0243359 | A1 | 11/2006 | Sano et al. | |
| 2009/0205390 | A1 | 8/2009 | Hermann et al. | |
| 2011/0048091 | A1 | 3/2011 | Kleber et al. | |
| 2015/0079440 | A1 | 3/2015 | Reich | |
| 2015/0291227 | A1 | 10/2015 | Bohner et al. | |
| 2017/0209909 | A1 | 7/2017 | Kavik et al. | |

FOREIGN PATENT DOCUMENTS

| | | | |
|---|---|---|---|
| CN | 102179422 | A | 9/2011 |
| CN | 104412428 | A | 3/2015 |
| DE | 4231213 | A1 | 3/1994 |
| DE | 4333500 | A1 | 4/1995 |
| DE | 19819484 | A1 | 11/1999 |
| DE | 102010035136 | A1 | 4/2011 |
| DE | 102014108111 | A1 | 10/2015 |
| DE | 102014110320 | A1 | 1/2016 |
| EP | 1101546 | A2 | 5/2001 |
| EP | 1621453 | A2 | 2/2006 |
| EP | 2085163 | A1 | 8/2009 |
| JP | 2014159038 | A | 9/2014 |

OTHER PUBLICATIONS

International Preliminary Report on Patentability for PCT/DE2016/100472 dated Apr. 5, 2017; 16pp.
International Search Report and Written Opinion for PCT/DE2016/100472 dated Feb. 23, 2017; 18pp.

* cited by examiner

α
w104
w1077
w1088
w1099
w1100
109
101
105
w103
108
110
w107
107
114
106
113
w108
100
102
111
112
104
103
B
C
D
E 200
201
A
B
C
D
A-A
w202a
B-B
204
203
202
w202b
C-C
D-D
w205
205
w203
d

METHOD FOR PRODUCING A MOTOR VEHICLE COMPONENT

CROSS REFERENCE TO RELATED APPLICATIONS

The present application is a National Phase of International Application Number PCT/DE2016/100472 filed on Oct. 11, 2016 and is related to and claims priority benefits from German Application No. 10 2015 118 099.5 filed Oct. 23, 2015.

BACKGROUND OF THE INVENTION

1. Field of the Invention

The disclosure is related a motor vehicle component, and more specifically, to a method for producing a motor vehicle component from a lightweight metal alloy.

2. Description of the Related Art

From the prior art it is known for motor vehicle components to be produced as press-formed components. To this end, a blank is provided, placed into a press-forming tool, and is subjected to three-dimensional shaping such that the motor vehicle component upon completion of the press-forming procedure is produced so as to have accurate contours.

Following the demand for lightweight construction and for improved crash properties of a motor vehicle body, it has furthermore been established in the prior art for motor vehicle components having wall thicknesses that are mutually dissimilar in regions to be produced. A production method of this kind is known, for example, from DE 43 33 500 A1.

In order for a wall thickness that in the cross section is mutually dissimilar to be produced, it is furthermore known from the prior art for a profile to be produced by means of extrusion, such that mutually dissimilar wall thicknesses are capable of being set by way of the choice of the shape-imparting extrusion tool. However, this offers the potential for producing profiles with wall thicknesses that are mutually dissimilar only in the direction that is transverse to the extrusion direction.

Furthermore, EP-A2-1 101 546 discloses a method in which a strip material of steel is produced by rolling, so as to form a strip material having regions of dissimilar thicknesses. The strip thereafter is cut to length and formed to a profile.

Proceeding from the prior art, it is therefore an object to propose a potential for producing a motor vehicle component having wall thicknesses that are mutually dissimilar in regions, said motor vehicle component being optimized for weight and at the same time optimized for a crash, and being producible with little complexity on a production line by an economical method.

SUMMARY

According to one exemplary embodiment, a method of manufacturing a motor vehicle component from a lightweight metal alloy, wherein a profile having at least two wall thicknesses that are mutually dissimilar in the cross section is extruded, is disclosed including rolling the extruded profile in portions, in particular in the extrusion direction, wherein the rollers in the roller spacing thereof are variable; cutting-to-length the extruded and in portions rolled profile so as to form a semi-finished product; forming, in particular press-forming, the semi-finished product so as to form the motor vehicle component.

It is therefore provided that a profile, in particular an endless profile, having at least two wall thicknesses that are mutually dissimilar in the cross section is initially produced.

Immediately upon extrusion, the extruded profile is rolled in portions in the extrusion direction. This means that a defined longitudinal portion of the extrusion profile is rolled. The rollers employed to this end, which are composed of at least one roller pair, are variable in their roller spacing. On account thereof, it is possible for a longitudinal portion of the extruded profile having a wall thickness that has been reduced by rolling to be produced. In particular, the at least two mutually dissimilar wall thicknesses of the extruded profile herein are rolled to a wall thickness which corresponds to the smaller wall thickness, or rolled to a further third wall thickness, wherein the third wall thickness is smaller in relation to the smaller wall thickness of the extrusion profile. However, the longitudinal portion can also be only widened and/or flattened, without the wall thickness being modified.

The profile thus extruded and machined by rolling is singularized so as to form semi-finished products. The semi-finished products herein can either have the form of a blank or already be a preform. The preform in the rolled longitudinal portions in this instance is flattened or rolled, respectively. The semi-finished product thus obtained in a subsequent press-forming step is press-formed so as to form the motor vehicle component and herein is formed to the final shape, in particular.

The motor vehicle component thus produced is distinguished by localized targeted setting potentials in terms of the required wall thickness, and by a simple and cost-effective production potential. The motor vehicle component produced is thus producible at low production costs, so as to be optimized for weight and optimized for a crash. The terms wall thickness and wall gauge hereunder are used as synonyms.

In particular, motor vehicle components selected from the group hereunder are produced by the method according to the invention: motor vehicle pillars, sills, roof spars, structural components in the body, longitudinal chassis beams, cross members, or the like.

However, it is also conceivable for axle components, for example control arms, to be produced by the method according to the invention.

Furthermore, the semi-finished product prior to or during press-forming is trimmed and/or perforated. The investment in materials is optimized in particular when the semi-finished product already corresponds to a preform of the motor vehicle component to be produced, such that cutting waste is minimized This effectively lowers the production costs by virtue of a reduced investment in materials and of reduced quantities of cutting waste.

The wall thicknesses that upon extrusion of the profile are mutually dissimilar differ by at least 10%. The wall thicknesses preferably differ by at least 15%, preferably at least 20%. It is conceivable for wall thickness differentials of up to 300% to be represented in one wall gauge step or wall thickness step, respectively. The wall thicknesses should typically mutually differ by between 10% and 100%. Thus, if a wall thickness region has a thickness of 1 mm, for example, the second wall thickness can be between 1.1 mm and 2 mm, preferably between 1.2 mm and 1.8 mm.

The transitional regions that result in the cross section between the wall thicknesses can be configured so as to be smooth. The transitional region from the thinner to the thicker wall thickness can run in a linear, a progressive, or a degressive manner. The transitional region can be configured on both sides of the extruded profile, consequently on an upper side and on a lower side of the latter. However, said transitional region can also be only on one side. The opposite side in the region of the transitional regions is planar or flat, respectively.

In particular, it is imaginable for sheet-metal gauges having a wall thickness between 1 and 4.5 mm, preferably 1.5 to 3 mm in the thin-walled regions, and 4 to 6 mm in the regions that in relation to the former are thick-walled, to be processed by the method according to the invention, when lightweight metal alloys, in particular aluminum alloys, are used. These sheet-metal thicknesses can then be further processed in multiple layers as flanges or peripheries of components, wherein an overall thickness of all joined layers which is smaller than 7 to 8 mm must be achieved. By contrast, the thickest single-layer wall thicknesses, for example in a peripheral region, by way of the extrusion method according to the invention can be configured so as to have a wall thickness of 4 to 6 mm Thus, in particular flange regions that are at least partially encircling can be made as thin-walled regions which can be coupled to other components. By virtue of the identical wall thickness in the flange regions, the same joining technology and/or the same joining aid, for example riveting, punch riveting, spot welding, laser welding, or the like, can be applied everywhere in the further processing. However, at the same time, by virtue of the extrusion method a higher wall thickness can be implemented in crash-relevant regions with an efficient investment in materials.

On account of the extrusion method it is also possible for a thickness step to be configured without a transitional region. One thickness step is thus to be provided. A wall thickness step herein is preferably configured only on one side. This means that one side of the extrusion profile is planar or flat, respectively, and the shoulder-type thickness step is located on the opposite side.

In particular, a wall thickness step should be configured in the range of a factor of 1 to 5, preferably of 1.5 to 3. This means that the larger wall thickness is 1.5 to 3 times that of the directly adjacent thinner wall thickness.

According to an exemplary embodiment, the profile is initially extruded having a cross section that deviates from that of a planar blank. An undulated cross section, in particular a hat-shaped cross-section, is preferably chosen. However, the cross section can also be configured so as to be C-shaped or Ω-shaped. The smaller extrusion width, in conjunction with subsequent rolling, enables the cut-to-length profile pieces, or the semi-finished products produced, respectively, to be able to be more readily transported and/or stored. On account of rolling that is downstream of extruding, it is now possible for the cross section to be widened and/or flattened. By way of the roller spacing of the at least one roller pair that is downstream of the extrusion device it is possible for the extruded profile to be flattened and/or widened in such a manner that the wall thickness on account of the rolling procedure is reduced across a longitudinal portion in the extrusion direction. This longitudinal portion is then rolled so as to form a plane or a blank, respectively. The profile produced is drawn off in a guided manner behind the rollers. Depending on the motor vehicle component to be produced, the profile that has been extruded having a non-planar cross section, consequently an undulated cross section or a hat-shaped cross section, respectively, is widened in portions in the longitudinal direction of the profile by rolling. The cross section can also be widened across the entire length of the extruded profile by rolling. The profile herein is widened up to a planar blank, however, the mutually dissimilar extruded wall thicknesses are maintained at least for one longitudinal portion. However, it is also possible for the extruded wall thickness to be reduced at least in portions, in particular completely. This relates in particular to the larger extruded wall thickness.

If a motor vehicle pillar is to be produced, for example, it is advantageous when an upper roof connection region and a lower sill connection region of the motor vehicle pillar to be produced are rolled so as to be planar or flat, respectively, and so as to have a homogeneous wall thickness, in particular. By contrast, an interdisposed pillar region is not rolled at all and/or only to a minimal extent, such that said interdisposed pillar region maintains a substantially C-shaped or hat-shaped cross-sectional contour having mutually dissimilar wall thicknesses. Once the profile that initially was extruded in an endless manner has been cut to length, semi-finished products which in the case described above already correspond to a preform are thus obtained. Endless herein means that, depending on the primary material that is provided for extruding, this is an extrusion profile with a finite length. However, said finite length is many times longer than the extruded blanks that are to be cut to length for production and further processing.

However, on account of the cutting-to-length that is downstream of rolling, a semi-finished product which at least in portions has a width, wherein the width is larger than a diameter of an envelope circle which frames the cross section of the extruded profile, is achieved in particular. The extruded profile is thus located in an envelope circle which frames the external points of the cross section of the profile.

After rolling, at least one longitudinal portion of the rolled profile, or of the semi-finished product, respectively, in the cross section has a width which is larger than the diameter of the envelope circle. Components which have a width that is larger than the extrusion tool can normally produce are thus producible.

Rolling per se is performed directly after extruding, wherein the material of the profile when being rolled still has a residual heat from extruding.

The residual heat after extruding is in particular between 250° C. to 600° C., preferably 350° C. to 550° C., in particular 400° C. to 500° C., particularly preferably 420° C. to 480° C., and most preferably approx. 450° C.

Roll-forming, which in turn is again downstream, can be directly performed in the state of residual heat at the abovementioned temperatures. However, roll-forming can also be performed upon cooling of the semi-finished product, wherein cooling is preferably performed to a temperature of 200° C. maximum, particularly preferably 20° C. to 150° C. and particularly preferably 20° C. to 80° C.

Moreover, aluminum wrought alloys are used in particular. The aluminum wrought alloys are in particular of the precipitation hardening type. An aluminum wrought alloy of the group 5000 or 6000 or 7000 as per DIN ENT 573-3 is preferably used.

According to an exemplary embodiment, a hat profile which in the cross section in the radii regions has a wall thickness that is larger in relation to a leg or web region, respectively, of the hat profile, can be extruded in particular. The wall thickness in the radii region would likewise be larger than the wall thickness of the flanges of the hat profile.

If a motor vehicle pillar is thus produced, in particular, the roof connection region that is later configured on the motor vehicle pillar, and the sill connection region that is later configured on the motor vehicle pillar can be rolled such that said regions are flat, on the one hand, but have a uniform wall thickness, on the other hand. Consequently, the wall thickness that in extruding is larger is rolled to at least the dimension of the smaller wall thickness. The wall thicknesses in the pillar region located therebetween are mutually dissimilar in the cross section.

In turn, the wall thickness of the sill connection region and the wall thickness of the roof connection region can be identical. However, said thicknesses can also be mutually dissimilar.

According to an exemplary embodiment, a motor vehicle B-pillar, which is produced from a lightweight metal alloy is also disclosed. The motor vehicle pillar has an upper connection region to a roof spar, and a lower connection region to a sill, and a pillar region extending therebetween. The pillar region at least in portions in the longitudinal direction is configured so as to be C-shaped, in particular hat-shaped, in the cross section. The motor vehicle pillar according to the invention is distinguished in that at least two mutually dissimilar wall thicknesses are configured in the cross section of the pillar region, wherein a wall thickness that is in each case homogeneous is configured in the cross section of the upper connection region and/or in the cross section of the lower connection region.

The motor vehicle pillar is produced by the method according to the invention. Accordingly, a profile which in the cross section has two mutually dissimilar wall thicknesses can be initially extruded. The profile in a further processing step is then partially rolled in the longitudinal direction such that said profile is widened and/or flattened, on the one hand, but that the mutually dissimilar wall thicknesses are also flattened, in particular to a homogeneous wall thickness, on the other hand. The motor vehicle pillar according to the invention can thus be produced with only a minor investment in raw materials. The roof connection region and/or the sill connection region that, as opposed to the pillar region, are/is widened can be produced by rolling such that the pillar region has almost the final configuration thereof, and that cutting waste by virtue of machining by cutting hardly arise.

Furthermore, the motor vehicle pillar in the longitudinal direction can be at least partially, preferably completely, coupled with a closing panel.

The upper connection region is also referred to as the roof connection region, and the lower connection region as the sill connection region. The roof connection region and/or the sill connection region can furthermore be shaped in three-dimensional manner Consequently, the cross section is not to be understood to be exclusively a planar blank, but the latter can also have a three-dimensional shaping, consequently a wall thickness that is homogeneous in the cross section, wherein the cross section is curved or shaped in another three-dimensional manner This is achieved in that further shape-imparting machining, for example in the form of press-forming, has taken place after extruding and rolling. On account of the individual rolling procedure after the extrusion of the wall thickness of the upper connection region and the wall thickness of the lower connection region herein can be configured so as to be identical. However, it is also possible for the wall thickness of the upper connection region to be configured so as to be dissimilar to the wall thickness of the lower connection region.

One further advantageous variant of the design embodiment of the motor vehicle pillar according to the invention provides that the lower connection region in the longitudinal direction of the motor vehicle pillar is again subdivided into two mutually dissimilar portions, wherein the wall thickness of an upper portion is configured so as to be dissimilar to the wall thickness of a lower portion. To this end, the wall thickness of the lower portion is preferably smaller than the wall thickness of the upper portion in the lower connection region. The lower portion can thus be used as the sill connection, for example, wherein the portion of the lower connection region lying thereabove in the event of a side impact to the sill again distributes the force in a targeted manner and/or is configured as a deformation region, for example. The lower portion of the lower connection region can also be configured so as to be thicker than the upper portion of the lower connection region.

The lower portion herein extends by a height h1 in the longitudinal direction of the motor vehicle pillar, wherein the height h1 is equal to or larger than a height h3 by which the upper connection region extends in the longitudinal direction of the motor vehicle pillar.

The smallest wall thickness in the pillar region is larger than or equal to the wall thickness in the upper connection region and/or the wall thickness in the lower connection region. The extruded profile can thus be rolled until a homogeneous wall thickness has been formed in the rolled longitudinal portion. This homogeneous wall thickness is preferably smaller than or equal to the smallest wall thickness of the extruded profile, consequently the smallest wall thickness in the pillar region.

Furthermore, the wall thickness in the upper connection region and/or the wall thickness in the lower connection region is smaller than or equal to the largest wall thickness of the pillar region. Depending on the rolling procedure performed, it is possible that a cross-sectional variation is performed in particular in the cross section in such a manner that edge-rolling of the cross section takes place and that the smaller wall thickness in the pillar region is increased in thickness.

The pillar region per se in the longitudinal direction at least in portions is configured so as to be particularly preferably hat-shaped in the cross section. Alternatively, it is also imaginable for the pillar region in the cross section to be configured so as to be Ω-shaped or Pi-shaped. Furthermore preferably, the cross section of the pillar region is variable in the longitudinal direction. This can be performed in particular by a rolling procedure and/or a press-forming procedure that is downstream of the rolling procedure.

Moreover, the largest wall thickness in an upper portion of the pillar region is larger than or equal to the largest wall thickness in a lower portion of the pillar region. The lower portion is thus configured as a deformation region, and the upper portion has a higher resistance to deformation. Alternatively, the largest wall thickness in a lower portion of the pillar region can also be configured so as to be larger than or equal to the largest wall thickness in an upper portion of the pillar region. By way of the production method according to the invention, it is in turn possible here too for the wall thickness of the extruded profile in the pillar region to be modified by at least partial rolling in the longitudinal direction.

Furthermore, the C-shaped cross section, in particular hat-shaped cross section, of the pillar region at least partially transitions into the upper connection region and/or into the lower connection region. In particular, the C-shaped cross section, in particular hat-shaped cross section, peters out and thus transitions smoothly into a homogeneous cross section, in particular planar cross section or slightly curved cross section, respectively. This smooth transition can be generated in particular by the rolling procedure during the production method and/or in subsequent press-forming per se.

Furthermore, a web having legs that laterally project from said web at an angle is configured in a cross section of the pillar region, wherein a radii region is configured in the transition from the web to the legs, and the wall thickness in the radii region is configured so as to be larger in relation to the wall thickness of the interdisposed web regions and/or to the wall thickness of the web or the legs. By way of extruding it is possible for the transition from the radii regions to the web, and for the transition from the radii regions to the legs, to be configured in a step-type manner. However, said transition can also be smooth, and thus no wall thickness step is to be provided. Furthermore particularly preferably, flanges that project from the legs are configured in the cross section in the pillar region, wherein the flanges have a smaller wall thickness in relation to the legs and/or to the web. It is thus possible for the motor vehicle pillar to be extruded so as to be optimized for weight and optimized for strength, and at the same time to be set by the rolling procedure with a view to the further weight optimization and strength distribution, while simultaneously reducing the cutting waste that arises in the production.

The legs and/or webs and the flanges described above in the cross section do not need to have a rectilinear profile, but can again have a curved profile.

Furthermore, the motor vehicle pillar in relation to the installed position thereof has a smooth surface on one external side, wherein the wall thickness variation is configured in particular in the pillar region on the internal side. In the case of a B-pillar, this offers the possibility that the passenger when opening the front and/or the rear motor vehicle door has a view of a smooth and thus an visually appealing aesthetic surface. The strength-enhancing features relating to mutually dissimilar wall thicknesses are disposed therebehind in a cavity and are thus not able to be visually perceived by the passenger or the vehicle driver, respectively. Particularly preferably, a closing panel is disposed on the rear side of the motor vehicle pillar. In particular, this closing panel is welded to the flanges.

According to one exemplary embodiment, a cross member for a motor vehicle is disclosed. Such a cross member is most often fitted to the front side or the rear side of a motor vehicle such that in the event of a rear-end collision the impact energy that is created therein is absorbed by the cross member and introduced into the motor vehicle body. To this end, a cross member is most often suspended on crash boxes, wherein the crash boxes convert the energy introduced into said crash boxes to deformation energy.

The cross member is configured from a lightweight metal alloy and in the cross section is configured so as to be hat-shaped. This means that said cross member has a central web, legs extending in a projecting manner at an angle from the ends of said central web and a flange in turn being configured at the end of the legs. The flanges herein are oriented in opposite directions, so as to project from the legs. The cross member has a cross section that is variable in the longitudinal direction of the cross member. The variation in the longitudinal direction can manifest itself in a dissimilar cross-sectional height and/or cross-sectional width and/or cross-sectional configuration. However, the variation of the cross section can also mean a variable wall thickness of the respective cross section in the longitudinal direction.

The cross member has mutually dissimilar wall thicknesses in a cross section, wherein likewise mutually dissimilar wall thicknesses are preferably likewise configured in a longitudinal section.

The cross member is produced by the method according to the invention. A profile from a lightweight metal alloy, having mutually dissimilar wall thicknesses in the cross section, can thus be initially extruded. Said profile is then partially rolled in the longitudinal direction by the method according to the invention. The wall thickness in the longitudinal direction is again influenced in the case of the rolling procedure. This can be performed in such a manner that the wall thicknesses that are mutually dissimilar in the cross section are completely flattened by a rolling procedure, so as to have a homogeneous wall thickness. However, the mutually dissimilar wall thicknesses can also be varied by the rolling procedure using profiled rollers such that two mutually dissimilar wall thicknesses are also present after the rolling procedure, wherein however at least one wall thickness is smaller than the wall thicknesses that have been produced after extruding.

It is possible for the primary material for the production of the cross member to be produced so as to be optimized for weight and optimized for stress, such that a cross member according to the invention is provided as a result which is produced so as to be optimized for weight and optimized for stress while investing the minimum raw materials required. Particularly preferably, the cross member is produced so as to have thicknesses in a central region in the installed situation that are relatively larger in relation to the end regions that relate to the transverse direction of the motor vehicle.

In particular, the hat-shaped cross-sectional profile is configured in such a manner that said cross-sectional profile has a central web, wherein one leg extends so as to project from each of the ends of the web. A flange is in turn disposed on an end of the leg that is opposite the web, wherein the flange is likewise configured so as to project from the leg at an angle. One radii region extends in each case between the flange and the leg, and between the leg and the web. The radii region preferably has a larger wall thickness in relation to the flange and/or the leg and/or the web. This larger wall thickness of the radii region extends at least in portions in the longitudinal direction. The cross member thus has a comparatively high resistance momentum in relation to an inherent deformation. The resistance momentum to bending is established by the height of the leg, the web, and/or the flange. However, at a smaller wall thickness in particular of the legs, said resistance momentum to bending is almost at the same level, such that a reduction in weight arises simultaneously with an optimization for stress.

In one further preferred variant of design embodiment, the two legs on a cross section have a mutually dissimilar wall thickness. On account thereof, one leg in a targeted manner can have a larger wall thickness so as to enable a better crash behavior, for example in the case of a bumper-to-bumper crash with an offset in height. For example, in the case of an off-road vehicle, the lower leg in the installed situation can have a wall thickness that is larger in relation to the upper leg, since in the case of a bumper-to-bumper crash with an offset in height the impact of a bumper of another motor vehicle on the lower leg is more probable.

Furthermore, the wall thickness of the web and/or the wall thickness of the leg and/or the wall thickness of at least one radii region is variable in the longitudinal direction of the cross member. At least two of the aforementioned regions preferably have mutually dissimilar wall thicknesses; in particular it is also possible for all regions, consequently the radii regions and/or the web and/or the leg and/or the flange to have a mutually dissimilar wall thickness in a cross section. This can be produced by extruding, in particular.

The variation in the longitudinal direction of the cross member is produced by the rolling procedure that is downstream of extruding.

Furthermore, the cross member is configured in such a manner that the wall thickness in relation to the longitudinal direction of the cross member decreases from a central region toward the ends. On account thereof, it is possible for the central region to have a comparatively high resistance momentum to bending in the case of a frontal impact, for example on a pole. A positive crash performance can thus be set with a weight-optimized design. Alternatively, it is also imaginable that the wall thickness in relation to the longitudinal direction of the cross member increases from a central region toward the ends. A combination of the afore-described potentials is also implementable in the context of the invention, such that the wall thickness of the legs in a central region is larger than the wall thickness of the legs in the end regions, for example.

Furthermore, the cross member in the longitudinal section preferably has a curved profile. This is achieved according to the invention in that the extruded and cut-to-length profile that has been partially rolled at least in the longitudinal direction in a further processing step is press-formed in a three-dimensional manner and then, in a simultaneous or subsequent method step, is bent transversely to the longitudinal direction.

The cross member in the installed position thereof, in relation to the transverse direction of the motor vehicle, in the end regions of the former preferably has a homogeneous wall thickness in the cross section, wherein a wall thickness that is mutually dissimilar is configured in the cross section in a central region.

Furthermore, in relation to the installed position of the cross member, the wall thickness variation on the external side of the latter, or the external surface shell, respectively, is configured so as to have a wall thickness step, and the internal side herein is configured so as to be substantially smooth. However, the wall thickness step can also be configured both on the external side as well as on the internal side. It is furthermore possible in the context of the invention, that a smooth surface is configured on the external side, and that the respective wall thickness step is configured on the internal side. However, the wall thickness step is preferably configured on the external side, and the internal side is configured so as to be smooth. On account of the wall thickness step it is furthermore possible for cams or protrusions, respectively, to be provided such that latching or catching, respectively, is established in the case of an impact. It can thus be avoided that the cross member slides across another cross member. On account of the smooth surface on the internal side, it is in turn possible for the cross member to be coupled to a crash box which preferably protrudes partially into the cross member.

Furthermore, in relation to the longitudinal direction, lateral clearances are present on the flanges in the ends of the cross member. On account thereof, a connection of the crash box or else the fastening of a pedestrian protection can be enabled, for example. A targeted crumpling behavior of the end region can also be set on account thereof.

Furthermore, the cross member, in relation to the longitudinal direction, can at least in portions, particularly preferably entirely, be coupled to a closing panel. The closing panel herein is coupled to the flanges, in particular.

Furthermore, a homogeneous wall thickness is configured at least in the cross section in the longitudinal direction, wherein in particular the homogeneous wall thickness is smaller than the largest wall thickness that is present in another cross-sectional region in the cross member. Particularly preferably, the homogeneous wall thickness is smaller than or equal to the smallest wall thickness that is present in another cross section in the cross member. At least partial rolling in order for the homogeneous wall thickness to be formed can thus be performed in the longitudinal direction on the extruded profile.

A sill for disposal on a motor vehicle body can be produced by the method according to one exemplary embodiment, wherein the sill is configured from a lightweight metal alloy and in the longitudinal direction at least in portions has a hat-shaped cross-sectional configuration, wherein the sill in the longitudinal direction has a variable cross section. In the case of the sill, mutually dissimilar wall thicknesses are present in at least one cross section, wherein the wall thickness is likewise variable in the longitudinal direction.

In particular, such a sill is welded into a motor vehicle body, particularly preferably into an integral motor vehicle body. By way of the production method according to the invention it is possible for a profile which in particular has a hat-shaped cross-sectional configuration having mutually dissimilar wall thicknesses to be initially extruded. On account of a rolling procedure that is downstream of the extruding and is performed at least partially in the longitudinal direction, it is possible for the cross section to be widened and/or for the wall thickness to be varied, in particular to be reduced in relation to the extruded wall thickness. A sill that is optimized for weight and simultaneously optimized for stress can thus be produced.

To this end, the sill in one region can have a homogeneous wall thickness, wherein the homogeneous wall thickness is smaller than or equal to, in particular smaller than the largest wall thickness in the sill. The homogeneous wall thickness is preferably smaller than or equal to the smallest wall thickness that is present in the remaining sill. The cross section having mutually dissimilar wall thicknesses that is present after extruding can thus be reduced or flattened, respectively, by rolling. Various longitudinal portions having mutually dissimilar cross-sectional configurations in the longitudinal direction can then be produced by way of a subsequent press-forming step. One longitudinal portion in the cross section can thus be configured so as to be hat-shaped, whereas a further longitudinal portion in the cross section is configured so as to be L-shaped, or else C-shaped or I-shaped, for example.

The sill in the cross section preferably has a web and at least one leg that projects from the web. Particularly preferably, a flange that projects from the leg is configured at the end of the leg. One radii region is configured in each case between the web and the leg, and between the leg and the flange. The wall thickness of the radii region at least in one longitudinal portion is preferably configured so as to be larger than the wall thickness of the web and/or the wall thickness of the sill and/or the wall thickness of the flange. Adequate rigidity in terms of flexing of the sill can thus be provided by the web and/or by the legs while enabling these regions to be configured in a weight-optimized manner, however. Furthermore, on account of the larger wall thickness in the radii regions, an improved crash performance in relation to the deformation of the sill in the case of an accident or of a side impact can in turn be established. By contrast, the mutually dissimilar wall thickness in regions subject to less stress can be reduced by the partial rolling in the longitudinal direction, such that the sill in turn is optimized for weight again here. A sill is in particular a lateral rocker panel of a motor vehicle body.

The sill in the longitudinal direction, by way of a closing panel or else by an inner sill that is coupled to said sill, can at least in regions, in particular completely, be coupled so as to form a hollow profile that is closed in the cross section.

In one further preferred variant of the design embodiment, a wall thickness that is larger in relation to the adjacent region of the same flange can be configured in a cross section in a flange. The wall thickness can thus be enlarged in a targeted manner in order for welding spots, cable conduits, or similar, to be placed, for example. A jacking portion for engaging a car jack can thus also be configured in a targeted manner Furthermore, the inboard side of the sill is configured so as to be smooth, and an outboard side has a wall thickness step, wherein the wall thicknesses that are mutually dissimilar in the cross section are configured so as to have a wall thickness transition in the form of a wall thickness step on the outboard side.

However, it would also be imaginable for the wall thickness transition to be configured on an inboard side, whereas the outboard side is configured so as to be smooth. In the context of the invention this means that a smooth side can also have a three-dimensional shaping but does not have a step-type wall thickness step per se.

The wall thickness transition in the cross section is configured in a step-type manner from a larger wall thickness to a smaller wall thickness. Minimal radii which are present after extruding are not taken into account herein. However, a completely curved profile is not be understood on account thereof. Said completely curved profile would however also be possible, such that there can be a progressive or else a degressive or round, respectively, transition in the form of a radius from a smaller wall thickness to a larger wall thickness in the cross section.

A roof spar for disposal on a motor vehicle body can also be produced by the method according to one exemplary embodiment, wherein the roof spar is configured from a lightweight metal alloy and in the longitudinal direction of said roof spar has an arcuate configuration, and in the cross section is configured so as to be C-shaped at least in portions. The roof spar in one cross section has mutually dissimilar wall thicknesses and in another cross section has a homogeneous wall thickness.

Here too, it is possible by way of the production method according to the invention for a profile which in the cross section has mutually dissimilar wall thicknesses to be initially extruded. Following the extrusion method, this profile in the longitudinal direction is rolled at least in portions, such that the mutually dissimilar wall thicknesses in at least one longitudinal portion are rolled to a homogeneous wall thickness. The roof spar in a further shape-imparting manufacturing step is press-formed in a three-dimensional manner, thereby being imparted an arcuate contour in the longitudinal direction of said roof spar, and various longitudinal portions having mutually dissimilar cross-sectional configurations. On account thereof, it is possible for a roof spar that is optimized for weight and also optimized for stress to be produced in a simple and cost-effective manner from a lightweight metal alloy.

The roof spar in a cross section has mutually dissimilar webs, wherein the individual webs, or web regions, respectively, mutually transition in each case into one radii region. A wall thickness that is larger than in the web regions is preferably configured in the radii regions.

The roof spar, in relation to the longitudinal direction thereof, in a central region is preferably configured so as to have a larger wall thickness in relation to the end regions that extend from the central region. This has an advantageous effect in the case of a roof-compression test, but also in the case of a rollover. Furthermore preferably, a homogeneous wall thickness and/or a wall thickness that is smaller than in the central regions is configured in the end regions. The wall thickness in relation to the longitudinal direction thus decreases from a central region toward the respective ends of the roof spar.

Furthermore, the roof spar in the installed position has a smooth surface on an external side. The wall thicknesses that are mutually dissimilar in the cross section furthermore have a wall thickness step which is configured on the internal side. A passenger or vehicle driver entering the motor vehicle is thus presented with a visually appealing and aesthetic smooth external side. The functionality of the higher stress capability on account of wall thicknesses that are mutually dissimilar in the cross section is thus not visible from outside.

The wall thickness transition from the smaller to the larger wall thickness is configured as a wall thickness transition and/or wall thickness step in the cross section. Said wall thickness transition is preferably configured only on one side in cross section. The opposite side is configured to be substantially smooth.

A motor vehicle pillar, in particular a motor vehicle B-pillar, which is configured from a lightweight metal alloy can furthermore be produced by way of the method according to the invention, said motor vehicle pillar having an upper connection region 21 to a roof spar, and a lower connection region 22 to a sill, and a pillar region 23 extending therebetween, wherein the pillar region 23 at least in portions is configured so as to be C-shaped in the cross section, said motor vehicle pillar being distinguished in that at least two mutually dissimilar wall thicknesses w3, w4 are configured in the cross section of the pillar region 23, wherein a homogeneous wall thickness (w5) is configured in each case in the cross section of the upper connection region 21 and/or in the cross section of the lower connection region 22.

Motor vehicle pillar as claimed in the preceding features, wherein the wall thickness w3 of the upper connection region 21, and the wall thickness w1 of the lower connection region 22 are identical or mutually dissimilar, wherein the respective wall thickness in the cross section is homogeneous.

Motor vehicle pillar according to the preceding features, wherein the lower connection region 22 in the longitudinal direction of the motor vehicle pillar is subdivided into two portions, wherein the wall thickness w2 of an upper portion 26 is dissimilar to the wall thickness w1 of a lower portion 25; in particular, the wall thickness w2 of the lower portion 25 is smaller than the wall thickness w1 of the upper portion 26.

Motor vehicle pillar according to the preceding features, wherein the lower portion 25 extends by a height h1 in the longitudinal direction 16, said height h1 being equal to or larger than a height (h3) by which the upper connection region 26 extends in the longitudinal direction 16.

Motor vehicle pillar according to the preceding features, wherein the smallest wall thickness in the pillar region 23 is larger than or equal to the wall thickness in the upper connection region 26 and/or in the lower connection region 25.

Motor vehicle pillar according to the preceding features, wherein the wall thickness in the upper connection region 26 and/or in the lower connection region 25 is smaller than or equal to the largest wall thickness in the pillar region 23.

Motor vehicle pillar according to the preceding features, wherein the wall thickness in the upper connection region 26 and/or in the lower connection region 25 is larger than or equal to the largest wall thickness in the pillar region 23.

Motor vehicle pillar according to the preceding features, wherein the pillar region 23 in the longitudinal direction 16 at least in portions is configured so as to be hat-shaped in the cross section.

Motor vehicle pillar according to the preceding features, wherein the pillar region 23 has a cross section that is variable in the longitudinal direction 16.

Motor vehicle pillar according to the preceding features, wherein the largest wall thickness in an upper part of the pillar region 23 is larger than or equal to the largest wall thickness in a lower part of the pillar region 23.

Motor vehicle pillar according to the preceding features, wherein the C-shaped cross section, in particular hat-shaped cross section, of the pillar region 23 at least partially transitions into the upper connection region 26 and/or into the lower connection region 25.

Motor vehicle pillar according to the preceding features, wherein a web having legs that laterally project from said web at an angle is configured in a cross section of the pillar region 23, wherein a radii region 24 is configured in the transition from the web to the legs, and the wall thickness in the radii region 24 is configured so as to be larger in relation to the wall thickness of the interdisposed web regions or sill regions.

Motor vehicle pillar according to the preceding features, wherein the transition from the radii region 24 to the web, and/or the transition from the radii region to the leg, are/is configured in a step-type manner, in particular so as to have a wall thickness step.

Motor vehicle pillar according to the preceding features, wherein flanges that project from the legs are configured in the cross section in the pillar region 23, wherein the flanges have a smaller wall thickness in relation to the legs and/or to the web.

Motor vehicle pillar according to the preceding features, wherein at least one of the legs and/or the web have a curved profile in the cross section.

Motor vehicle pillar according to the preceding features, wherein the motor vehicle pillar in relation to the installed position thereof has a smooth surface on an external side, and the wall thickness variation is configured on the internal side.

Furthermore, a cross member for disposal on a motor vehicle can be produced, wherein the cross member 100 is configured from a lightweight metal alloy and in the cross section is configured so as to be hat-shaped and has a cross-section that is variable in the longitudinal direction 101 of the cross member 100, and is distinguished in that mutually dissimilar wall thicknesses are configured in a cross section and mutually dissimilar wall thicknesses are configured in a longitudinal section.

Cross member according to the preceding features, wherein the hat-shaped cross-sectional profile has a web 106 from which legs 107 extend so as to project at an angle $\alpha$, flanges 108 projecting from the legs 107, wherein one radii region 109 is configured in each case between the web 106 and the legs 107, and/or one radii region 110 is configured in each case between the legs 107 and the flanges 108.

Cross member according to the preceding features, wherein a wall thickness that is larger in relation to a flange 108 and/or a leg 107 and/or the web 106 is configured in a radii region 109, 110.

Cross member according to the preceding features, wherein the two legs 107 have mutually dissimilar wall thicknesses in the cross section.

Cross member according to the preceding features, wherein the wall thickness of the web 106 and/or the wall thickness of the leg 107 and/or the wall thickness of a radii region 109, 110 is variable in the longitudinal direction 101 of the cross member 100.

Cross member according to the preceding features, wherein the wall thickness, in relation to the longitudinal direction 101, decreases from a central region 103 toward the ends, or in that the wall thickness, in relation to the longitudinal direction 101, increases from a central region 103 toward the ends.

Cross member according to the preceding features, wherein the wall thickness variation in relation to the installed position of the cross member 100 is configured on the external side 113 of the latter, and/or in that a smooth surface is configured on an internal side 114, and/or in that the wall thickness transition in the cross section is configured in a step-type manner Cross member according to the preceding features, wherein, in relation to the longitudinal direction 101, lateral clearances 111 are present in end regions on the flanges 108.

Cross member according to the preceding features, wherein a homogeneous wall thickness is configured in a cross section, wherein in particular the homogeneous wall thickness is smaller than or equal to the largest wall thickness that is present in another cross section in the cross member 100, preferably is smaller than or equal to the smallest wall thickness that is present in another cross section in the cross member 100.

Furthermore, a sill for disposal on a motor vehicle body can be produced, wherein the sill 200 is configured from a lightweight metal alloy, and in the longitudinal direction 201 at least in portions has a hat-shaped cross-sectional configuration, wherein the sill 200 in the longitudinal direction 201 has a variable cross section and is distinguished in that mutually dissimilar wall thicknesses are present in at least one cross section and that the wall thickness is variable in the longitudinal direction 201.

Sill according to the preceding features, wherein a homogeneous wall thickness is present in a cross section, wherein in particular the homogeneous wall thickness is smaller than or equal to the largest wall thickness that is present in the sill 200; preferably the wall thickness is smaller than or equal to the smallest wall thickness that is present in the sill 200.

Sill according to the preceding features, wherein the sill 200 has a web 202 in the cross section and at least one leg 203 that projects from the web 202, wherein a radii region 205 is configured in the transition from the web 202 to the leg 203, and the radii region 205 has a wall thickness that is larger in relation to the leg 203 and/or the web 202.

Sill according to the preceding features, wherein a wall thickness is configured in the cross section in a flange 204 that is larger in relation to the adjacent wall thickness in the same flange 204.

Sill according to the preceding features, wherein an inboard side of the sill 200 in the installed position is configured so as to be smooth, and an outboard side has the wall thickness transition.

Sill according to the preceding features, wherein the wall thickness transition from a larger wall thickness to a smaller wall thickness in the cross section is configured in a step-type manner Furthermore, a roof spar for disposal on a motor vehicle body can be produced, wherein the roof spar 300 is configured from a lightweight metal alloy and in the longitudinal direction 301 thereof has an arcuate configuration, and in the cross section at least in portions is configured so as to be C-shaped, and is distinguished in that mutually dissimilar wall thicknesses are configured in one cross section, and said roof spar 300 in another cross section has a homogeneous wall thickness.

Roof spar according to the preceding features, wherein a homogeneous wall thickness is configured in a cross section, wherein preferably the homogeneous wall thickness is smaller than or equal to the largest wall thickness of the roof spar 300, or in particular the homogeneous wall thickness is smaller than or equal to the smallest wall thickness of the roof spar.

Roof spar according to the preceding features, wherein, in relation to the installed position, the external side 306 of the roof spar 300 has a smooth surface, and that the internal side 308 has the wall thickness transition.

Roof spar according to the preceding features, wherein the wall thickness in the cross section decreases in the longitudinal direction 301 from a central region toward the ends.

Roof spar according to the preceding features, wherein the roof spar 300 has a web 302 and at least one leg 303 that extends from the web 302 at an angle, wherein a radii region 305 is configured between the web 302 and the leg 303, and the wall thickness of the radii region 305 is larger than the wall thickness of the web 302 and/or of the web 303.

Roof spar according to the preceding claims, wherein the wall thickness transition in the cross section is configured in a stepped manner.

All features described above and all properties of the various products related to said features, in particular of the motor vehicle pillar, of the sill, of the roof spar, and of the cross member, can be combined with one another in an arbitrary manner and can be applied to the respective other product or component, respectively.

BRIEF DESCRIPTION OF THE DRAWINGS

For an understanding of embodiments of the disclosure, reference is now made to the following description taken in conjunction with the accompanying drawings, in which.

In the Figures, the same reference signs are used for identical or similar components, even if a repeated description is omitted for reasons of simplicity.

DETAILED DESCRIPTION OF SOME EMBODIMENTS

Figure 1:
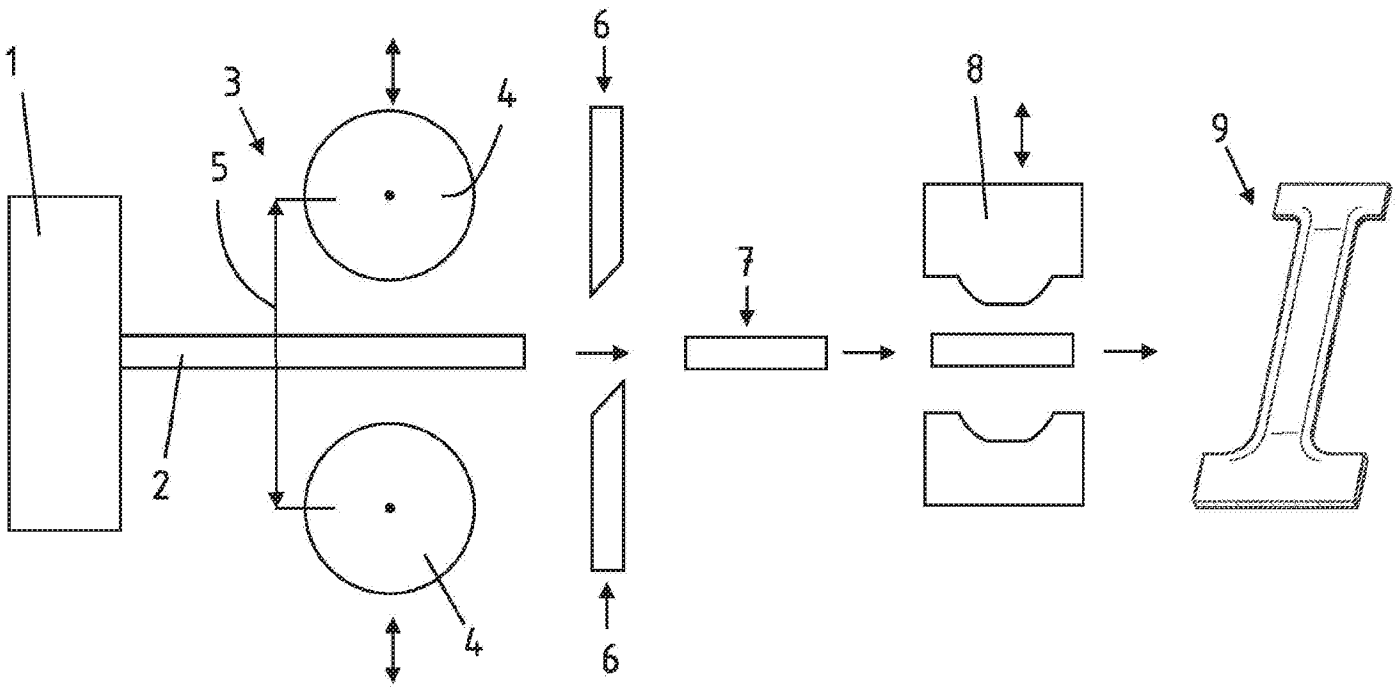
FIG. 1 is an exploded schematic overview of the method according to an exemplary embodiment.

Some embodiments will be now described with reference to the Figures. FIG. 1 shows a schematic overview of the method according to the invention. To this end, an extrusion device 1 is provided from which a profile 2 is initially extruded. A rolling device 3 having a roller pair 4 is disposed directly after the extrusion device 1. The spacing 5 of the roller pair 4 is adjustable in a variable manner, that is to say can be enlarged or reduced. To this end, actuators (not illustrated in more detail) are provided on the rollers. The roller pair 4 is followed by a trimming device 6 for singularizing the extruded and rolled profile 2 so as to form semi-finished products 7. The semi-finished products 7 are then fed to a forming press 8 and herein are press-formed so as to form a motor vehicle component 9. The semi-finished product 7, or the formed motor vehicle component 9, respectively, can be trimmed and/or perforated prior to, during, or after the forming press 8. The process cycles of extruding and of rolling as well as of press-forming can be decoupled. This cycle decoupling is preferably performed after singularizing.

Figure 2:
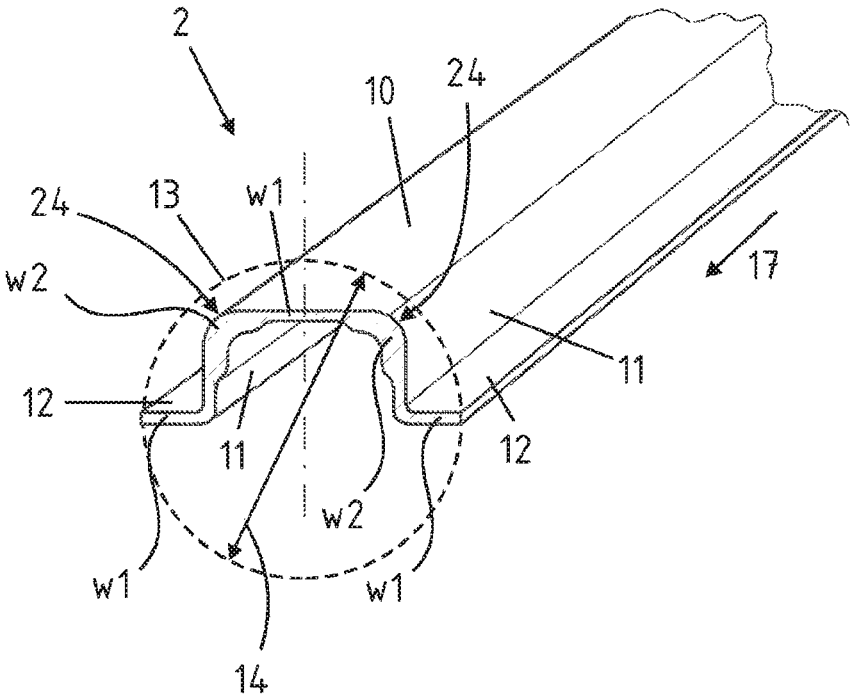
FIG. 2 is an extruded profile.

FIG. 2 shows the extruded profile 2 in a perspective detailed view. The mutually dissimilar wall thicknesses w1 and w2 can be seen. The wall thickness w2 herein is configured so as to be larger than the wall thickness w1. The extruded profile 2 in the cross section has a hat shape, having a web 10 and having legs 11 that extend from the web 10, and having flanges 12 which in turn project from said legs 11. An envelope circle 13 which frames the cross section of the hat profile has a diameter 14, wherein the diameter 14 is smaller than a width 15 of the rolled profile 2 that is illustrated in FIG. 3. It is further illustrated in FIG. 2 that a wall thickness w2 that in the cross section is larger than in the web 10 as well as in the region of the legs 11 is configured in the radii regions 24. Transition regions extend in each case therebetween. The wall thickness w2 herein is 1.5 to 3 times larger than the wall thickness w1.

Figure 3A:
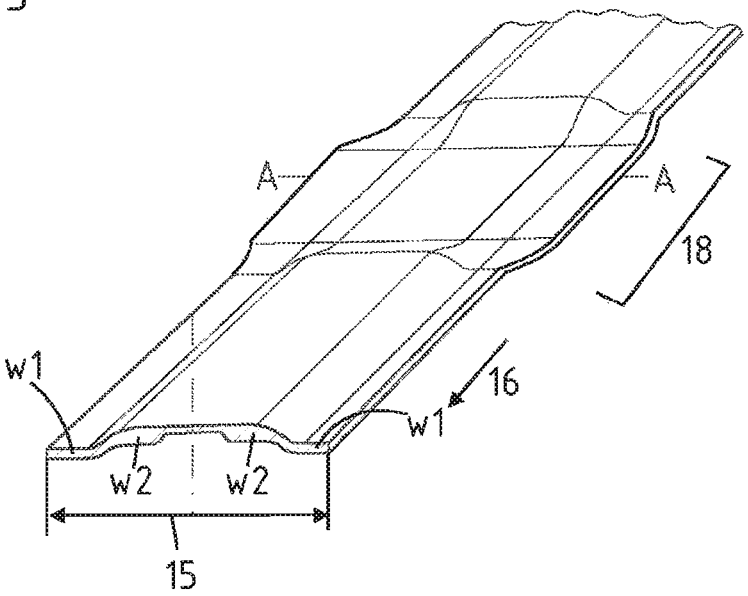
FIGS. 3*a* and 3*b* illustrate the extruded profile after rolling.

Referring to FIG. 3*a*, the extruded profile 2 has been rolled. To this end, said profile 2 has been completely rolled in the longitudinal direction 16 of the profile 2, wherein the longitudinal direction 16 quasi corresponds to the extrusion direction 17, said profile 2 having thus been lengthened but also widened. However, the profile 2 in a defined longitudinal portion 18 has been rolled more intensively such that the cross-sectional configuration is once more modified in the longitudinal direction 16. According to the front-end view of FIG. 3*a*, the mutually dissimilar wall thicknesses w1 and w2 remain so as to be configured in the less intensively rolled longitudinal portions 25.

Figure 4:
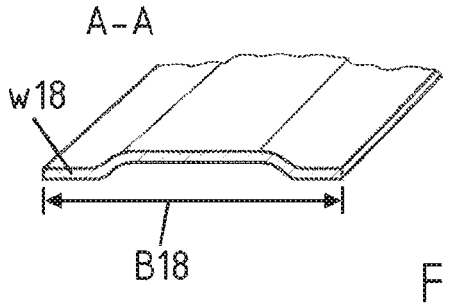
FIG. 4 is a sectional view taken along line A-A in FIG. 3.

Referring to FIG. 4 illustrating a side view according to the section line A-A, the blank in the longitudinal portion 18 has been rolled in such a manner that said blank has been lengthened and widened and such that the wall thicknesses have also been modified to a homogeneous wall thickness w18. The homogeneous wall thickness w18 corresponds to the smaller wall thickness w1 of the extruded profile 2, or is configured so as to be smaller than the wall thickness w1 of the extruded profile 2. The width B18 is larger than the width 15.

Figure 3B:
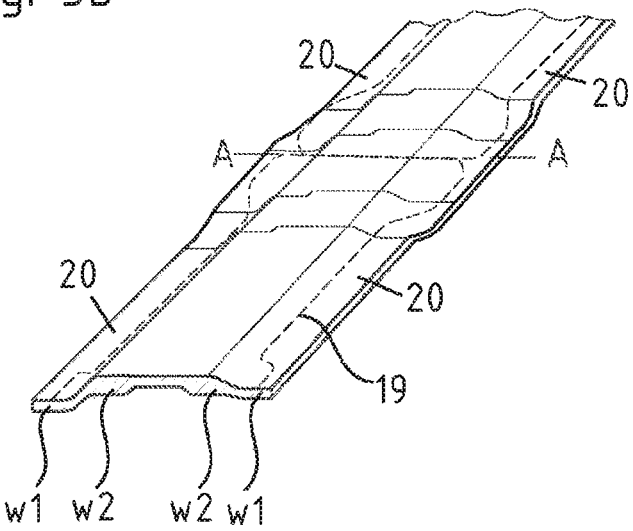

Furthermore, the blank contours 19 which are used for the preform of the motor vehicle component 9 to be produced later are illustrated with a dashed line in FIG. 3*b*. It can readily be seen that respective peripheral regions 20 are removed by machining by cutting.

As seen in FIG. 4, the profile 2 in the longitudinal portion 18 has not been completely rolled flat or rolled out, respectively. Said profile 2 in the cross section still has a hat-shaped configuration. However, on account of the rolling procedure, the wall thickness has been rolled to a homogeneous wall thickness w18.

Alternatively, however, it would also be imaginable for the longitudinal portion 18 to be completely rolled such that the wall thickness w1, w2, is reduced to w18, on the one hand, but that a flat cross section is also obtained, on the other hand.

Figure 5:
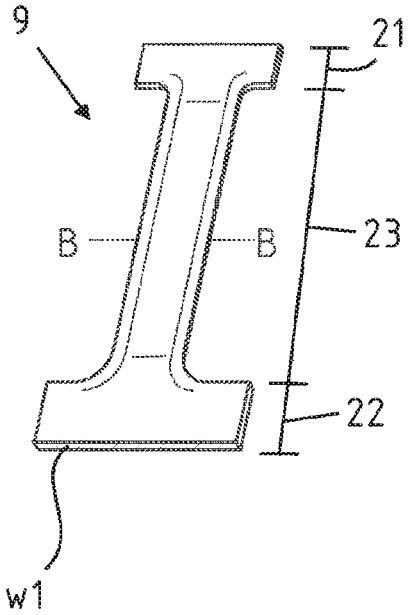
FIG. 5 illustrates a motor vehicle pillar produced by the method according to an exemplary embodiment.
Figure 6:
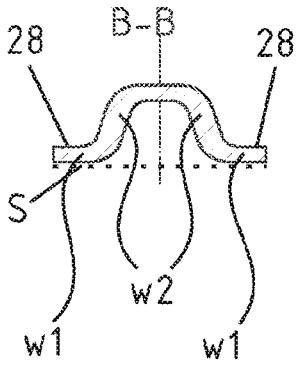
FIG. 6 is a cross-sectional view through the motor vehicle pillar taken along the line B-B in FIG. 5.

FIG. 5 now shows a motor vehicle component 9 produced in the form of a B-pillar. The latter has a roof connection region 21, a sill connection region 22, and a pillar portion 23 that extends therebetween. The motor vehicle component 9, having mutually dissimilar wall thicknesses w1, w2 according to the section line B-B illustrated in FIG. 6, is likewise configured in a hat shape in the pillar portion 23. The cross-sectional line B-B differs from that from FIG. 2, since the extruded and rolled profile 2 has been press-formed. A respective motor vehicle component 9 in the roof connection region 21 and the sill connection region 22 is rather configured so as to be flattened, having a homogeneous wall thickness w1 or smaller, for example w18, but in particular so as to be smaller than the larger wall thickness w2 according to the section line B-B. The motor vehicle component 9 can thus be configured so as to be optimized for a crash and optimized for weight, above all because the larger wall thickness w2 by way of the production of the preform by means of extrusion again can also be disposed in a targeted manner in crash-relevant regions which represent a higher degree of rigidity in use. The wall thickness w2 herein is preferably 1.5 to 2.5 times, in particular 1.8 to 2.2 times, preferably 2 times larger than the wall thickness w1. A closing panel S which in particular is coupled to the flanges 28 can optionally be provided.

Figure 7:
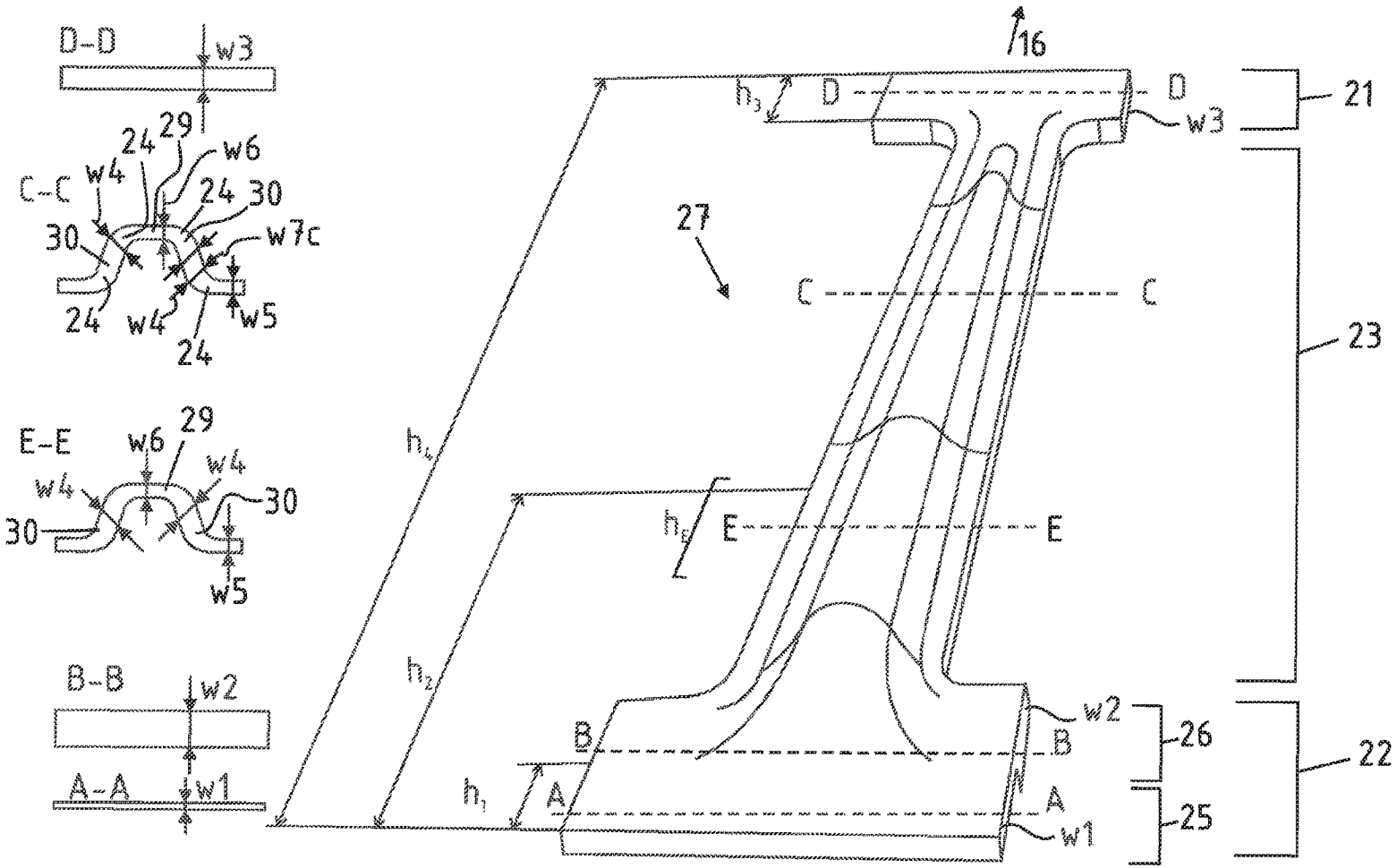
FIG. 7 illustrates an embodiment of a motor vehicle pillar produced by the method according to an exemplary embodiment.

FIG. 7 shows an alternative variant of the design embodiment of FIG. 5. The motor vehicle pillar 27 likewise has a roof connection region 21, a sill connection region 22, and a pillar portion 23 that extends therebetween. By contrast to FIG. 5, however, the sill connection region 22 is yet again divided into two. Said sill connection region 22 has a lower portion 25 having a wall thickness w1 which is smaller than a wall thickness w2 that lies above the former and is part of an upper portion 26. The wall thickness differentials w1, w2 are achieved by dissimilar rolling in the longitudinal direction 16. The wall thickness is in each case homogeneous across the cross section, as can be seen according to section line A-A and B-B. In the roof connection region 21, a wall thickness w3 that is mutually dissimilar can also be set so as to be homogeneous in the cross section, said wall thickness w3 again being produced by rolling in the longitudinal direction 16. The wall thickness w3 herein is not equal to the wall thickness w2 and also not equal to the wall thickness w1. The wall thickness w3 can be larger than the wall thickness w1 but smaller than the wall thickness w2.

The pillar region 23 that extends therebetween has a configuration that is hat-shaped in the cross section. Mutually dissimilar wall thicknesses w4, w5 in the cross section are produced by the extrusion method here. The wall thickness w4 in a respective radii region 24 of the cross-sectional profile to be produced herein is larger than or equal to the wall thickness w2. The hat-shaped cross section furthermore has a wall thickness w5 that is dissimilar to said wall thickness w4. The wall thickness w5 is smaller than the wall thickness w4; the wall thickness w5 is preferably larger than or equal to the wall thickness w2. The motor vehicle pillar 27 in the longitudinal direction 16 has an overall height h4. By contrast, the roof connection region 21 extends by a height h3. An entire deformation region in the lower part of the motor vehicle pillar has a height h2 which extends across approx. one third of the height h4. Furthermore, the lower sill connection region 22 is configured in two parts, wherein the homogeneous wall thickness w1 is configured in a lower portion 25 at a height h1, and the wall thickness w2 is then configured on the upper portion 26 lying thereabove.

The hat-shaped cross sectional profile, in each case in the transition from the roof connection region 21 to the pillar portion 23 and from the pillar portion 23 to the sill connection region 22, then transitions into a flat profile that has been produced by rolling. However, it is preferably possible for roof connection region 21 and/or the sill connection region 22, initially produced by rolling, to be once again formed in a three-dimensional manner In this case, a semi-finished product or a blank, respectively, which subsequently is placed into a forming press (not illustrated in more detail) according to FIG. 7 such that three-dimensional shaping takes place once again. In particular, the connection regions 21 and 22 in each case have a 3-D contour which is adapted to the roof frame and the sills and which is configured in a downstream shape-imparting step, for example. In particular, an uppermost or lowermost part in relation to the installed position can once again be bent such that the roof spar or the roof frame is partially encompassed, for example. The same applies additionally or alternatively to a sill.

According to the section line E-E, an optional default deformation region is furthermore illustrated. Said default deformation region can extend in particular at a height hE in the longitudinal direction 16 of the motor vehicle pillar 27, wherein the height hE is configured so as to be at least 20 mm, preferably at least 30 mm, and most particularly preferably smaller than one third of the height h4. The default deformation zone according to the section line E-E furthermore preferably has a wall thickness w6 in a web region 29 that lies between the two radii regions. The wall thickness w6 of the web region according to the section C-C is preferably also configured in the remaining pillar portion in the portion 23. The wall thickness w7*e* in a leg 30 is preferably configured so as to be smaller than the wall thickness w7*c* in the remaining pillar portion. The wall thickness w4E in the respective radii region can also be configured so as to be smaller than the wall thickness w4 in the remaining pillar region, for example according to the section line C-C. On account thereof, a default buckling point can be configured in the default deformation region in a transition on the lower third of the motor vehicle pillar on account of the smaller wall thickness w7*e* and w4*e*. The default deformation region is thus disposed in the transition region between the lower third and the upper two thirds of the entire motor vehicle pillar.

In a further variant of the design embodiment, the wall thickness of the flanges w5, the wall thickness w1, and the wall thickness w3 are particularly preferably configured so as to be identical. This in particular offers the advantage that the same joining technology, for example rivet welding, punch riveting, resistance spot welding, or else laser welding or another joining technology, can be applied in an encircling manner A joining method that in each case is individually adapted to the entire layer thickness does not have to be employed. The wall thickness is preferably configured so as to be between 1 and 3 mm such that an entire thickness of the layers to be joined to other components is configured so as to be smaller than or equal to 8 mm, in particular smaller than or equal to 7 mm. The wall thickness w4 can furthermore preferably be configured so as to have a thickness between 3 and 6 mm, so as to achieve a correspondingly high flexural rigidity. The wall thickness w7 of a respective leg 30 in this instance is preferably configured so as to be between the wall thicknesses w4 and w1. Furthermore, the wall thickness w2 is particularly preferably smaller than the wall thickness w4. FIGS. 8*a* to *e* show a cross member 100 according to the invention in a front view, various cross-sectional views, and a longitudinal sectional view. The cross member 100 herein, in the longitudinal direction 101 thereof, has a substantially identical cross-sectional height 102. The cross member 100 furthermore has a central region 103 and end regions 104 which in each case adjoin the central region 103.

Figures 8A, 8B, 8C, 8D, 8E:
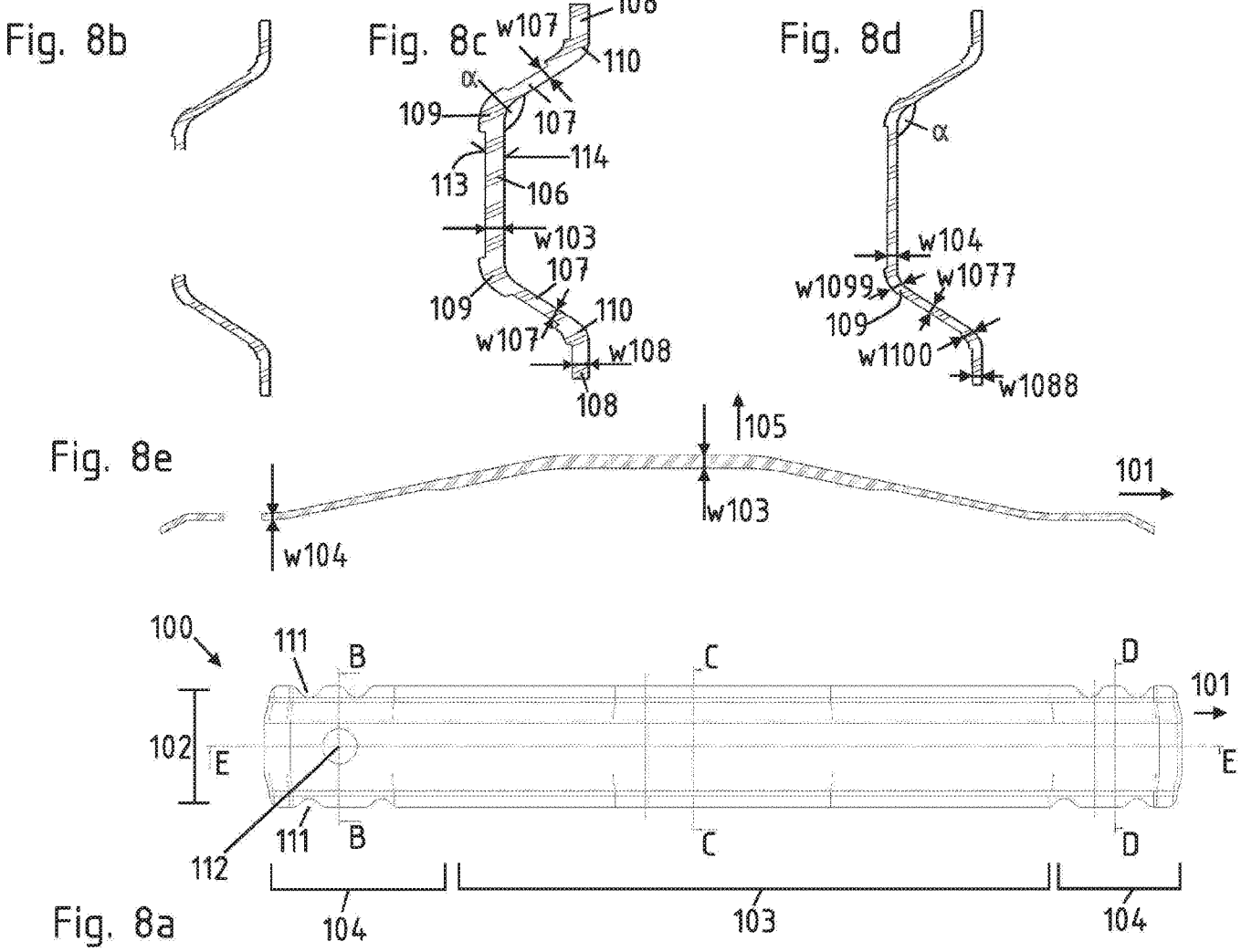
FIGS. 8*a* to 8*e* illustrate a cross member produced in accordance with an exemplary embodiment having dissimilar cross sections, including a longitudinal section.

FIG. 8*e* herein shows a longitudinal section according to the section line E-E from FIG. 8*a*. It can be seen that the cross member 100 in the longitudinal direction 101 has a curved profile. This means that said cross member 100 is configured so as to be curved along the longitudinal axis thereof, wherein an arc of the curvature in the installed position is directed toward the front in relation to the travel direction 105. It can be seen that the cross member 100 has a wall thickness w104, w103 that is variable in the longitudinal direction 101. A wall thickness w103 is configured in a central region 103, whereas a wall thickness w104 is configured in each case in the end regions 104, and the wall thickness w104 is smaller than the wall thickness w103.

Furthermore illustrated are three cross-sectional views along the section lines B-B, C-C, and D-D. It can be readily seen that in each case at least two mutually dissimilar wall thicknesses are configured in the cross sections. The wall thicknesses in the end regions 104 according to the section line B-B and D-D are configured so as to be smaller than the wall thicknesses in the central region 103 according to the section line C-C.

The cross member 100 according to the invention in the cross section has a hat profile having a centrally disposed web 106. A leg 107 extends in each case from the web 106 at an angle $\alpha$ to the latter, and flanges 108 which protrude outward are in turn disposed on the ends of the legs 107, wherein the two flanges 108 are preferably oriented in opposite directions. The angle $\alpha$ at which the legs 107 project from the web 106 can be variable in the longitudinal direction 101, such that the angle $\alpha$ in the central region 103 is configured so as to be smaller than the angle $\alpha$ in the end regions 104. In particular, a higher resistance momentum to bending is configured on account thereof by virtue of the legs 107 that are disposed in a rather perpendicular manner, having the web 106 in the central region 103.

The legs 107 in the central region 103 have a wall thickness w107, as opposed to a wall thickness w1077 in the end regions 104. The flanges 108 in the central region 103 also have a wall thickness w108 which is configured so as to be larger in relation to a wall thickness w1088. The respective wall thickness in the case of this variant of embodiment thus decreases from the central region 103 toward the end regions 104. One radii region 109 is configured in each case between the web 106 and the legs 107, and a radii region 110 is in turn configured between the legs 107 and the flanges 108. The wall thickness w109 and w110 of the radii region 109, 110 according to FIG. 8*c* is in each case larger than the wall thickness w106, w107, w108 of the web 106 and/or the leg 107 and/or the flange 108. Radii regions 109, 110 which likewise have a wall thickness w1099 and w1100 that is configured so as to be larger in relation to the wall thickness w104, w1077, and w1088 are likewise configured in the end regions 104. The wall thicknesses w1100 and w1099 of the radii regions 109, 110 in the end regions 104 is however configured so as to be smaller than the wall thickness w109, w110 of the radii regions 109, 110 in the central regions 103.

The cross member 100 furthermore has clearances 111 in the end regions 104 on the flanges 108. Crash boxes can be disposed here, for example.

Furthermore, an assembly bore 112 through which a tow eyelet (not illustrated in more detail) can be fitted is optionally provided. It can furthermore be seen according to the cross-sectional views of FIGS. 8*b* to *d* that the cross member 100 has an external side 113 and an internal side 114. The respective thickness step by way of which mutually dissimilar wall thicknesses in a cross section are configured herein is illustrated here on the external side 113. The internal side 114 is thus formed in a three-dimensional manner, but is inherently smooth. Consequently, there is also no thickness step configured on the internal side 114. A reversed or symmetrical arrangement of the thickness steps is possible.

Figures 9A, 9B, 9C, 9D, 9E, 9F:
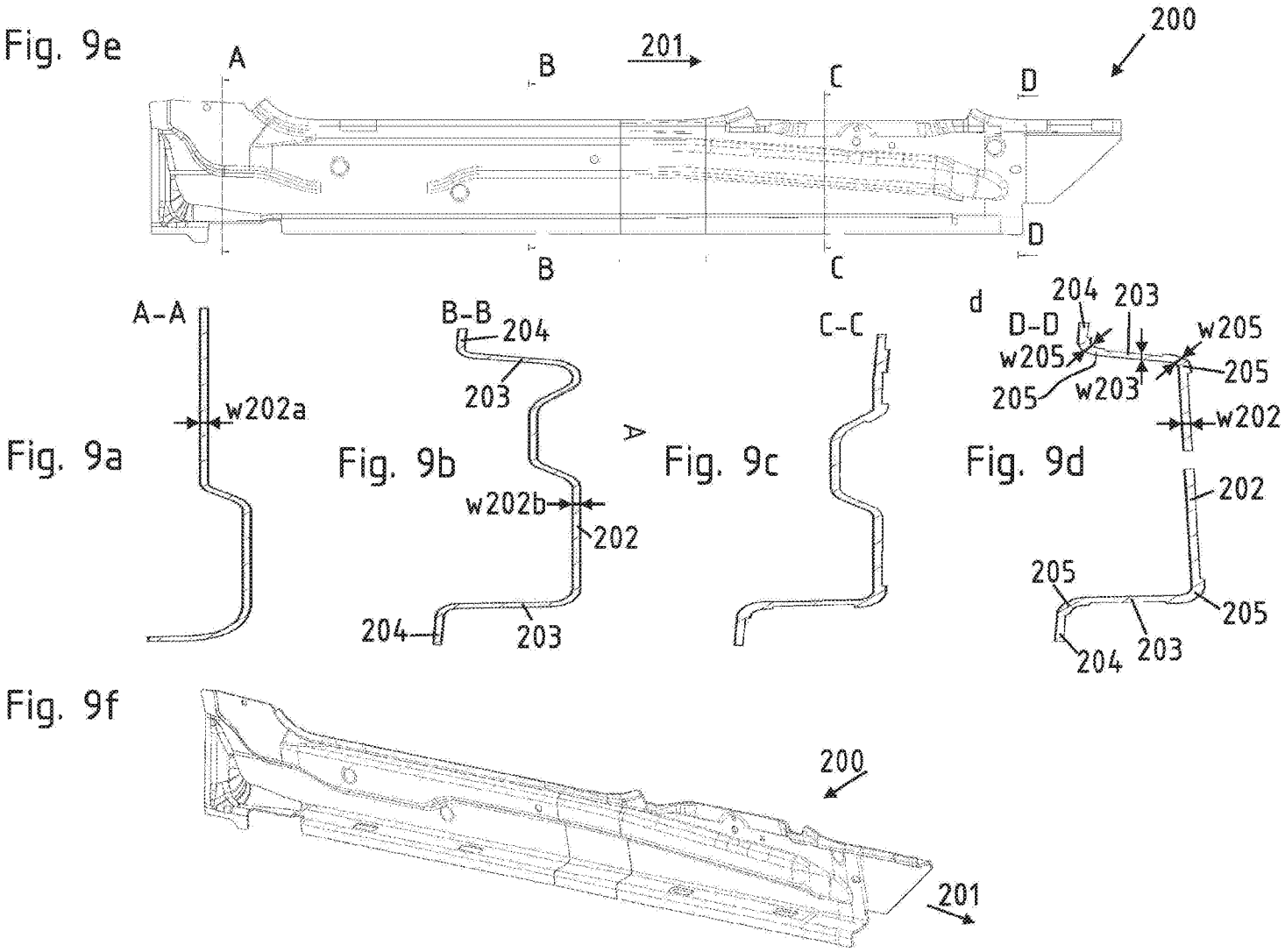
FIGS. 9*a* to 9*f* are perspective, side, and various cross sectional views of a sill produced in accordance with an exemplary embodiment.
Figure 10D:
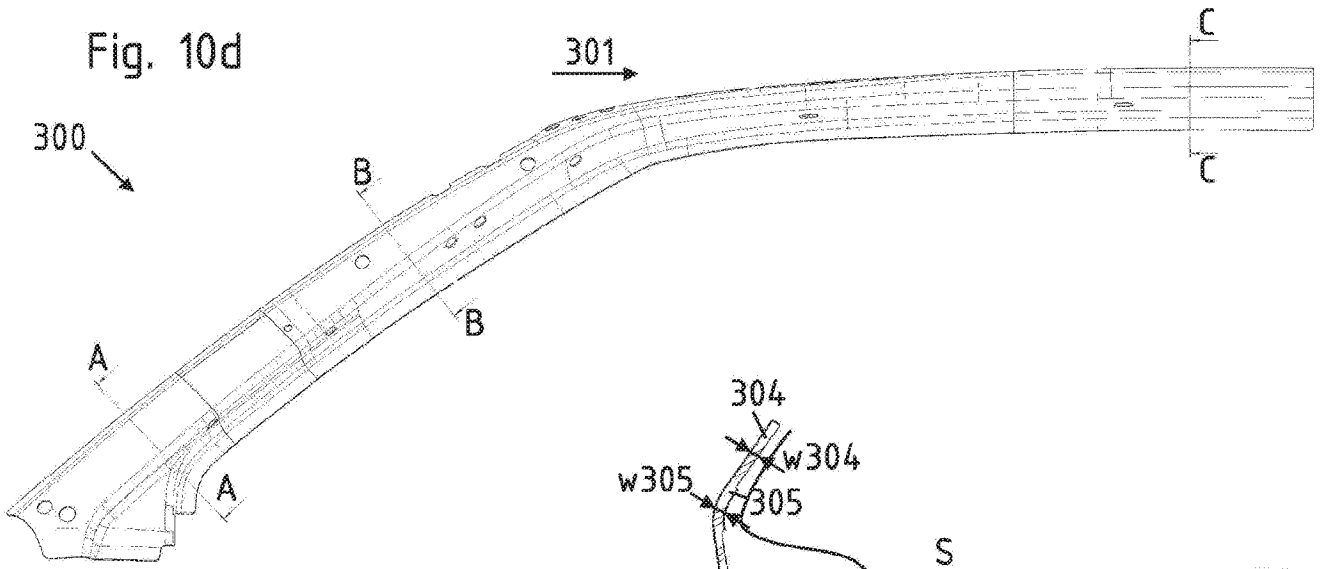
FIGS. 10 to 10*d* are side and various cross sectional views of a roof spar produced in accordance with an exemplary embodiment; and, FIGS. 11*a* to 11*g* are plan, perspective, and side views of a cross member produced in accordance with an exemplary embodiment.
Figure 10C:
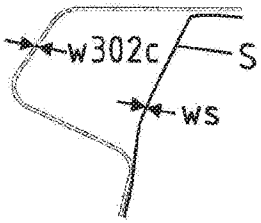
Figure 10B:
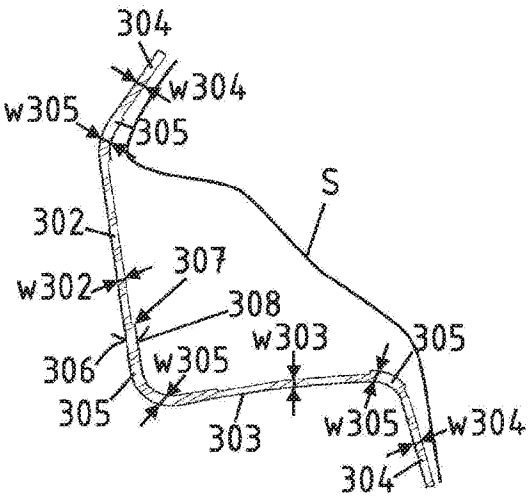
Figure 10A:
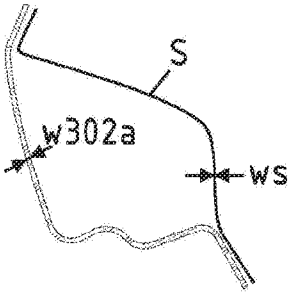

FIGS. 9*e* and 9*f* show a sill 200 according to the invention in a perspective view and in a side view. The sill 200 herein in the longitudinal direction 201 thereof has a variable cross section, wherein various cross-sectional views are illustrated in FIGS. 9*a* to 9*d*. It can be seen in FIGS. 9*b* and *d* the sill 200 in the longitudinal direction 201 at least in portions has a hat-shaped cross-sectional profile. This cross-sectional profile has a web 202, legs 203 that extend from the web 202, and again flanges 204 that project from the legs 203. One transitional region in the form of a radii region 205 is configured in each case between the flange 204 and the leg 203, and between the leg 203 and the web 202. It can be readily seen in the case of the cross section according to FIG. 9*d* that at least two mutually dissimilar wall thicknesses w202, w203, and w204, are configured in the cross section, and again a wall thickness w205 that is dissimilar to the former wall thicknesses w202, w203, and w204, is configured in the radii regions 205. In particular, the wall thickness w205 in the radii regions 205 herein is configured so as to be larger than all other wall thicknesses. The wall thicknesses w204, w203, and w202 of the flange 204, of the leg 203, and of web 202 can be configured in the same manner, but can also be mutually dissimilar.

According to the section line of FIGS. 9*a* and 9*b*, a homogeneous wall thickness which corresponds to the wall thickness w202, for example, is in each case configured. This is implemented in that the mutually dissimilar wall thicknesses that are present after extruding are at least partially flattened in the longitudinal direction by the rolling procedure. The wall thickness w202*a* and w202*b* according to the cross section in FIG. 9*a* or FIG. 9*b* can in this instance be smaller than or equal to the wall thickness w202 of the web. The cross-sectional view according to FIG. 9*c* also has mutually dissimilar wall thicknesses which correspond substantially to the various wall thicknesses of FIG. 9*d*; however, another cross-sectional configuration has been chosen here. The mutually dissimilar cross-sectional configurations are set by a three-dimensional press-forming procedure that is downstream of extruding and rolling. The outwardly oriented thickness steps can also be inboard. Furthermore preferably, w202*a* is smaller than w202*b*, in particular smaller by a factor of 1.5 to 3.

FIGS. 10*a* to 10*d* show a roof spar 300 produced according to the invention in a side view and three different cross-sectional views. The roof spar 300 herein in the longitudinal direction 301 thereof has a variable cross section. Overall, the roof spar 300 in the longitudinal direction 301 has a profile that is curved in an arcuate manner. According to FIG. 10*b* which illustrates a cross section in a central region, it can be readily seen that the roof spar 300 has mutually dissimilar wall thicknesses on a web 302, a leg 303, and flanges 304 that project from the web 302 and the leg 303. The wall thicknesses w302, w303, w304 can all be equal, but can also all be mutually dissimilar. One respective transitional region in the form of a radii region 305 is configured in each case between the flange 304 and the web 302, and between the web 302 and the leg 303, and again between the leg 303 and the flange 304. The radii region 305 has an enlarged wall thickness w305. In turn, all radii regions 305 in the cross section can have the same wall thickness w305. However, in relation to the image plane, the upper radii region and the right radii region can also have a wall thickness that is dissimilar to that of the central radii region. An external side 306 in relation to the installed position is configured so as to be smooth, wherein the respective thickness step 307, consequently the variation of the wall thickness, is configured on an internal side 307. According to the section line A-A and C-C, the end regions in relation to the longitudinal direction 301 in each case have a homogeneous wall thickness w302*a*, w302*c* which is smaller than or equal to the wall thickness w302. Consequently, the end regions of the roof spar 300 in the longitudinal direction 301 are partially rolled such that the mutually dissimilar wall thicknesses are configured so as to be homogeneous.

A closing panel S which extends across the entire roof spar and is coupled to the flanges in terms of joining technology can furthermore be provided. The closing panel has a wall thickness ws which is preferably constant across the entire closing panel. Furthermore, the wall thickness w302*a* is homogeneous or constant, respectively, as is the wall thickness w302*c*. In particular, w302*a* w302*c* can also be configured in the same manner The wall thickness w305 preferably has a thickness of 1.5 to 4 mm. The wall thickness w304 preferably has a thickness of 1 to 3 mm. In particular, the wall thicknesses w302 and w303 are in particular smaller than the wall thickness w305. Said wall thicknesses w302 and w303 can be equal in size to the wall thickness w304, consequently from 1 to 3 mm.

FIG. 11 shows an alternative cross member 400. The latter in the longitudinal direction 401 thereof, according to the longitudinal sectional view, has a constant wall thickness w402. The cross member 400 in the cross section thereof, according to FIG. 11*a*, has a hat-shaped profile having a web 402, legs 403 that extend from the latter, and again projecting flanges 404. The cross section has a plurality of mutually dissimilar wall thicknesses w402, w403, w404. A wall thickness w402 is thus configured in the web 402. Said wall thickness w402 transitions into a wall thickness w402R, having a radii region 405 and being larger than said wall thickness w402, and into the leg 403. A wall thickness w403 which is smaller than the wall thickness w402 and also smaller than the wall thickness w402R is again configured in the leg 402. Said wall thickness w403 in the direction of the flange 404 transitions into the wall thickness w403F which is configured so as to be smaller than the wall thickness w403, said wall thickness w403F in turn transitioning into a wall thickness w404 of the flange 404.

Figure 11A:
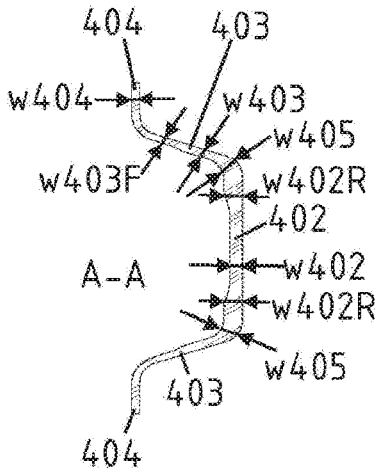
Figure 11G:
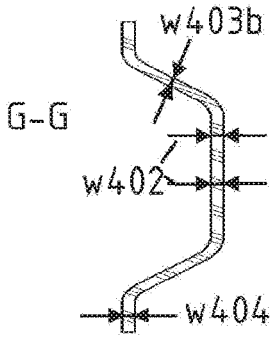
Figure 11E:
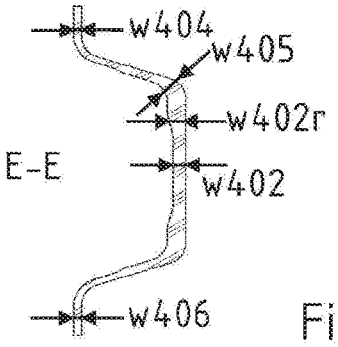
Figure 11C:
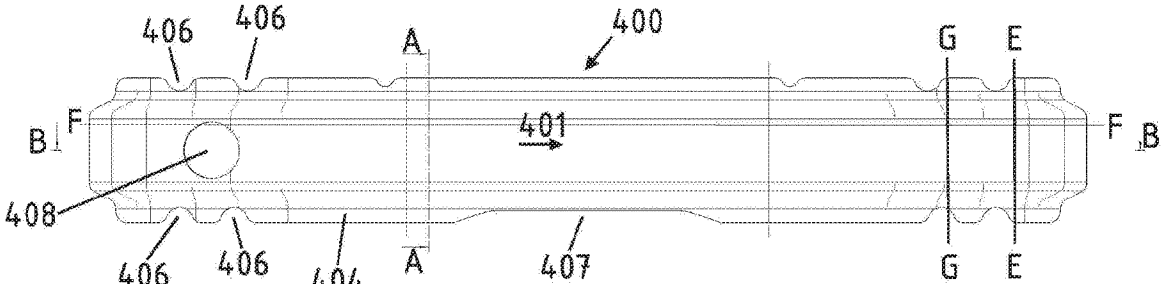
Figure 11D:
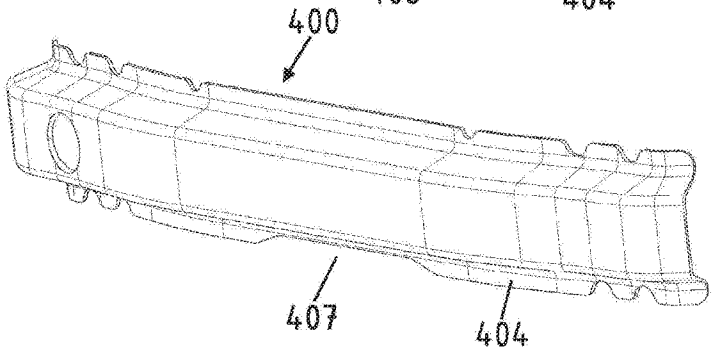
Figure 11B:
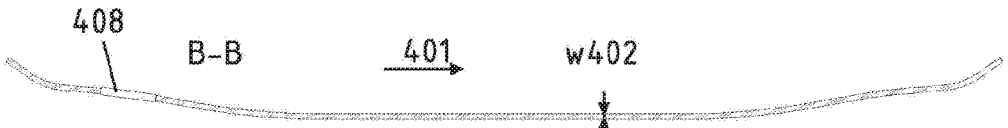

Overall, the cross member according to FIG. 11*b* has a curvature and end regions 408 that are yet again bent. Clearances 406 are furthermore present in the upper flange and in the lower flange. Likewise, a large recess 407 is optionally configured on the lower flange 404.

A crash box is connected in the region of the section line B-B. The larger wall thickness in the radii regions w405 and w402 is rather not configured. Forthwith however, the wall thickness in the region of the web w402 is configured in the same manner The wall thickness in the region of the flanges w404 in relation to the section line A-A is likewise configured in the same manner However, the wall thickness in the region of the leg w403*b* can be smaller than the wall thickness w403 in the region of the section line A-A such that a weaker configuration is established for connecting the crash box. In turn, a larger wall thickness is configured in the region of the section lines C-C, so as to provide a small overlap end portion for the event of a crash. According to the section line C-C, said small overlap end portion in turn has a larger wall thickness w405 in the radii region 405. The wall thickness w402 in the region of the web, but also the wall thickness w404 in the region of the flange, are however again configured in the same manner as the wall thickness w402 and w404 according to the section line A-A, but also according to the section line B-B.

The thickness step established in extruding is preferably possible both on the inside as well as on the outside. The wall thickness in the radii region w405 is preferably 1.5 to 3 times larger in relation to the wall thickness in the radii region w405, in particular larger in relation to the wall thickness w402 by a factor of 1.5 to 3.

Figure 11F:
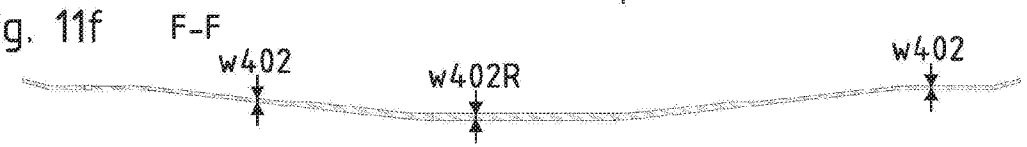

Furthermore, as is illustrated in FIG. 11*f*, section line illustration according to the section line F-F in the longitudinal section of FIG. 11*c*, an enlarged wall thickness w402*r* is configured here in a central portion when viewed in the longitudinal direction 401. This can also be seen in FIG. 11*a*. The wall thickness w402*r* is configured according to FIG. 11*a* and decreases toward the ends. According to the section line G-G in FIG. 11*g*, only one wall thickness w402 which is smaller than the wall thickness w402*r* is configured here. The wall thickness w402*r* and w405 in the radii region in turn can optionally increase, as is illustrated in FIG. 11*e*, according to the section line H-H from FIG. 11*c*. However, since this is possible only as an option, this is not illustrated in FIG. 11*f*. In particular, according to the section line G-G, a correspondingly thinner wall thickness w402 is thus configured in the connection region of a crash box. An identical wall thickness w404 can again be configured overall in the flange regions 404, in order for an identical joining technology to be applied across the entire longitudinal extent of the cross member for all having a closing panel, for example.

The foregoing description of some embodiments of the invention has been presented for purposes of illustration and description. It is not intended to be exhaustive or to limit the invention to the precise form disclosed, and modifications and variations are possible in light of the above teachings or may be acquired from practice of the invention. The specifically described embodiments explain the principles and practical applications to enable one ordinarily skilled in the art to utilize various embodiments and with various modifications as are suited to the particular use contemplated. It is intended that the scope of the invention be defined by the claims appended hereto, and their equivalents. Further, it should be understood that various changes, substitutions and alterations can be made hereto without departing from the spirit and scope of the invention as described by the appended claims.

The invention claimed is:

1. A method for producing a motor vehicle component from a lightweight metal alloy, wherein a profile having at least two dissimilar wall thicknesses in the cross section is extruded, comprising:

providing rollers having variable spacing;

rolling the extruded profile in portions between the rollers to set, by said rolling, a wall thickness which is smaller than or equal to a smaller wall thickness of the extruded profile;

cutting the extruded cross section to length and in portions of the rolled profile so as to form a semi-finished product; and forming the semi-finished product so as to form the motor vehicle component.

2. The method of claim 1, wherein the forming comprises press-forming, said method further comprising:

trimming or perforating the semi-finished product prior to or during the press-forming, or performing the rolling in an extrusion direction in which the profile is extruded.

3. The method of claim 2, wherein the two dissimilar wall thicknesses differ by at least 10%.

4. The method of claim 1, further comprising extruding the profile to have an undulating cross section.

5. The method of claim 4, further comprising widening, by the rolling, the cross section across an entire length of the extruded profile.

6. The method of claim 4, wherein at least some portions of the semi-finished product in a longitudinal direction of the profile have a width larger than a diameter of an envelope circle which frames the cross section of the extruded profile.

7. The method of claim 1, further comprising widening a portion of the cross section of the profile in a longitudinal direction of the profile by the rolling.

8. The method of claim 1, wherein the rolling is performed directly after extruding the profile, and while the profile being rolled in the rolling still has a residual heat from the extruding.

9. The method of claim 8, wherein the residual heat is between 350° C. and 550° C.

10. The method of claim 8, wherein the residual heat is between 400° C. and 500° C.

11. The method of claim 1, wherein the extruded profile comprises an aluminum wrought alloy 5000, 6000, or 7000 as per DIN ENT 573-3.

12. The method of claim 1, further comprising:

performing the rolling or the forming in a state of residual heat from extruding the profile, the residual heat being between 400° C. and 500° C., or performing the rolling or the forming upon cooling of the semi-finished product at 20° C. to 100° C.

13. The method of claim 12, wherein the cooling comprises cooling the semi-finished product at 30° C. to 70° C.

14. The method of claim 1, wherein the motor vehicle component is a pillar having an upper roof connection region and a lower sill connection region, and a pillar portion extending therebetween, further comprising:

configuring at least two mutually dissimilar wall thicknesses in the cross section in the pillar portion, and configuring a homogeneous wall thickness in each case in the cross section of the roof connection region and in the cross section of the sill connection region.

15. The method as claimed in claim 14, wherein the wall thickness of the sill connection region and the wall thickness of the roof connection region are mutually dissimilar.

16. The method of claim 1, wherein the forming comprises press-forming.

17. The method of claim 1, further comprising extruding the profile so as to have a hat-shaped cross section.

18. The method of claim 17, further comprising producing a wall thickness in the cross section in radii regions of the motor vehicle, wherein the wall thickness is larger in relation to a web of a sill or to a plurality of legs of the web.

19. A method of producing a motor vehicle component, the method comprising:

extruding a lightweight metal alloy into a profile having at least two dissimilar wall thicknesses in a cross section of the profile;

feeding the extruded profile into a variable spacing between rollers, and rolling a portion of the extruded profile between the rollers to set, by said rolling, a wall thickness which is smaller than or equal to a smaller wall thickness of the extruded profile;

after said rolling, cutting the profile in a portion other than the rolled portion to form a semi-finished product; and forming the semi-finished product so as to form the motor vehicle component.

* * * * *